US012134939B2

(12) United States Patent
Ma et al.

(10) Patent No.: US 12,134,939 B2
(45) Date of Patent: Nov. 5, 2024

(54) DRILLING DEVICE, AND DRILLING CONSTRUCTION METHOD FOR AN ELECTRIC POWER IRON TOWER FOUNDATION

(71) Applicants: JINHUA ELECTRIC POWER DESIGN INSTITUTE CO., LTD., Zhejiang (CN); JINHUA POWER SUPPLY COMPANY, STATE GRID ZHEJIANG ELECTRIC POWER CO., LTD., Zhejiang (CN)

(72) Inventors: Jian Ma, Zhejiang (CN); Yuhui Ma, Zhejiang (CN); Zhe Chen, Zhejiang (CN); Yunguo Yang, Zhejiang (CN); Wenwu Li, Zhejiang (CN); Gang Xu, Zhejiang (CN); Wei Sun, Zhejiang (CN); Yunxiang Zhu, Zhejiang (CN); Qing Lv, Zhejiang (CN)

(73) Assignees: Jinhua Electric Power Design Institute Co., Ltd., Zhejiang (CN); Jinhua Power Supply Company, State Grid Zhejiang Electric Power Co., Ltd., Zhejiang (CN)

( * ) Notice: Subject to any disclaimer, the term of this patent is extended or adjusted under 35 U.S.C. 154(b) by 50 days.

(21) Appl. No.: 18/004,588

(22) PCT Filed: Jun. 23, 2022

(86) PCT No.: PCT/CN2022/100743

§ 371 (c)(1),
(2) Date: Jan. 6, 2023

(87) PCT Pub. No.: WO2022/228586

PCT Pub. Date: Nov. 3, 2022

(65) Prior Publication Data

US 2023/0250696 A1 Aug. 10, 2023

(30) Foreign Application Priority Data

Apr. 25, 2021 (CN) ..... 202110448905.5
Apr. 25, 2021 (CN) ..... 202110450374.3

(51) Int. Cl.
*E21B 15/04* (2006.01)
*E21B 7/02* (2006.01)
(Continued)

(52) U.S. Cl.
CPC ..... *E21B 15/04* (2013.01); *E21B 7/024* (2013.01); *E21B 15/003* (2013.01);
(Continued)

(58) Field of Classification Search
CPC ..... E21B 15/045; E21B 7/026; E21B 21/015
See application file for complete search history.

(56) References Cited

U.S. PATENT DOCUMENTS 6,161,358 A 12/2000 Mochizuki et al.
2017/0190526 A1 7/2017 Oren et al.
2018/0058150 A1 3/2018 Lock et al.

FOREIGN PATENT DOCUMENTS

CA 2279148 A1 1/2000
CA 2856533 A1 3/2015
(Continued)

OTHER PUBLICATIONS

Written Opinion in International Application No. PCT/CN2022/100743, mailed Sep. 28, 2022.
(Continued)

*Primary Examiner* — Robert E Fuller
(74) *Attorney, Agent, or Firm* — Kim IP Law Group LLC

(57) ABSTRACT

A drilling device includes a hydraulic drilling unit, a multi-way connector, a compressed air conduit, a plurality of air compressor units, an air duct, a dust removal unit and an
(Continued)

operation bench. The hydraulic drilling unit is capable of moving among a plurality of drilling platforms and among a plurality of hole positions on the plurality of drilling platforms and performing a drilling operation. The plurality of air compressor units are disposed in a fixing and mounting region that is between the plurality of drilling platforms. The dust removal unit includes a dust collection cover and a dust remover, where the dust collection cover is configured to be located at any one of the plurality of hole positions, the dust remover is disposed in the fixing and mounting region, and the dust collection cover and the dust remover are connected through the air duct.

20 Claims, 13 Drawing Sheets

(51) Int. Cl.
*E21B 15/00* (2006.01)
*E21B 21/01* (2006.01)
*E21B 21/015* (2006.01)

(52) U.S. Cl.
CPC ..... *E21B 15/045* (2013.01); *E21B 21/011* (2020.05); *E21B 21/015* (2013.01)

(56) References Cited

FOREIGN PATENT DOCUMENTS

| | | | | | |
|---|---|---|---|---|---|
| CA | 2959901 | A1 | | 9/2017 | |
| CN | 2806821 | Y | | 8/2006 | |
| CN | 201554369 | U | | 8/2010 | |
| CN | 102364028 | A | | 2/2012 | |
| CN | 102373882 | A | | 3/2012 | |
| CN | 105370206 | A | | 3/2016 | |
| CN | 105888544 | A | | 8/2016 | |
| CN | 205895136 | U | | 1/2017 | |
| CN | 106437511 | A | | 2/2017 | |
| CN | 110725648 | A | | 1/2020 | |
| CN | 210049820 | U | | 2/2020 | |
| CN | 112065272 | A | | 12/2020 | |
| CN | 113090185 | A | | 7/2021 | |
| CN | 113107357 | A | | 7/2021 | |
| WO | WO-0235052 | A1 | * | 5/2002 | ..... E21B 21/01 |
| WO | WO-2009077656 | A1 | * | 6/2009 | ..... E21B 21/16 |

OTHER PUBLICATIONS

International Search Report mailed Sep. 28, 2022 in International Application No. PCT/CN2022/100743.

* cited by examiner

DRILLING DEVICE, AND DRILLING CONSTRUCTION METHOD FOR AN ELECTRIC POWER IRON TOWER FOUNDATION

CROSS-REFERENCE TO RELATED APPLICATION(S)

This is a national stage application filed under 35 U.S.C. 371 based on International Patent Application No. PCT/CN2022/100743, filed Jun. 23, 2022, which claims priority to Chinese Patent Application No. 202110448905.5 filed Apr. 25, 2021 and Chinese Patent Application No. 202110450374.3 filed Apr. 25, 2021, the disclosures of which are incorporated herein by reference in their entireties.

TECHNICAL FIELD

The present application relates to the technical field of electric power iron tower foundation construction, for example, a drilling device and a drilling construction method for an electric power iron tower foundation.

BACKGROUND

The construction of an electric power iron tower foundation is usually carried out in mountainous and hilly areas. Firstly, drilling platforms are built, and then holes are drilled on the drilling platforms.

In the related art, a drilling construction device for a rock and soil foundation is large in volume and weight, and a drilling process requires the transfer among multiple drilling platforms and the transfer among multiple hole positions of the drilling platforms, resulting in low drilling efficiency, and the transfer of the drilling device requires a large manual labor cost and a large manual labor intensity.

SUMMARY

The present application provides a drilling device and a drilling construction method, so as to solve problems of low drilling construction efficiency and high manual labor intensity.

An embodiment of the present application provides a drilling device. The drilling device includes a hydraulic drilling unit, a multi-way connector, a compressed air conduit, a plurality of air compressor units, an air duct, a dust removal unit and an operation bench (console). The hydraulic drilling unit is capable of moving among a plurality of drilling platforms and among a plurality of hole positions on the plurality of drilling platforms, and performing a drilling operation. The plurality of air compressor units are disposed in a fixing and mounting region that is between the plurality of drilling platforms, where compressed air outputted by the plurality of air compressor units flows jointly through the multi-way connector and then is transmitted to the hydraulic drilling unit through the compressed air conduit. The dust removal unit includes a dust collection cover and a dust remover, where the dust collection cover is configured to be located at any one of the plurality of hole positions, the dust remover is disposed in the fixing and mounting region, and the dust collection cover and the dust remover are connected through the air duct. The operation bench is connected to the hydraulic drilling unit, the plurality of air compressor units and the dust remover for communication and control.

An embodiment of the present application provides a drilling construction method for an electric power iron tower foundation. The method includes the steps described below.

A fixing and mounting region among a plurality of drilling platforms is determined according to a layout of the plurality of drilling platforms of the electric power iron tower foundation, and a moving route of a hydraulic drilling unit is determined according to distribution of a plurality of drilling hole positions on the plurality of drilling platforms.

A plurality of air compressor units and a dust remover are arranged in the fixing and mounting region, and the hydraulic drilling unit is provided on any one of the plurality of drilling platforms.

An operation bench is placed according to a sight line requirement, where the operation bench is communicatively connected to the hydraulic drilling unit, the plurality of air compressor units and the dust remover.

A dust collection cover is provided at an aperture position of a first one of the plurality of hole positions on one drilling platform of the plurality of drilling platforms, and the dust collection cover is connected to the dust remover through an air duct.

Drilling is performed on the first one of the plurality of hole positions on the one drilling platform through the hydraulic drilling unit and drilling is completed on all the plurality of hole positions on the one drilling platform the plurality of drilling platforms in sequence according to the moving route.

Whether the one drilling platform is a last one of the plurality of drilling platforms is determined; and based on a result that the one drilling platform it is not the last one of the plurality of drilling platforms, the hydraulic drilling unit moves to a next drilling platform of the plurality of drilling platforms, a dust collection cover is provided at an aperture position of a first one of the plurality of hole positions on the next drilling platform of the plurality of drilling platforms and the dust collection cover is connected to the dust remover through an air duct, and drilling is performed on the first one of the plurality of hole positions on the next drilling platform through the hydraulic drilling unit, and drilling is completed at all the plurality of hole positions on the next drilling platform of the plurality of drilling platforms in sequence according to the moving route, until drilling at all the plurality of hole positions on all the plurality of drilling platforms are completed.

REFERENCE LIST

Figure 1:
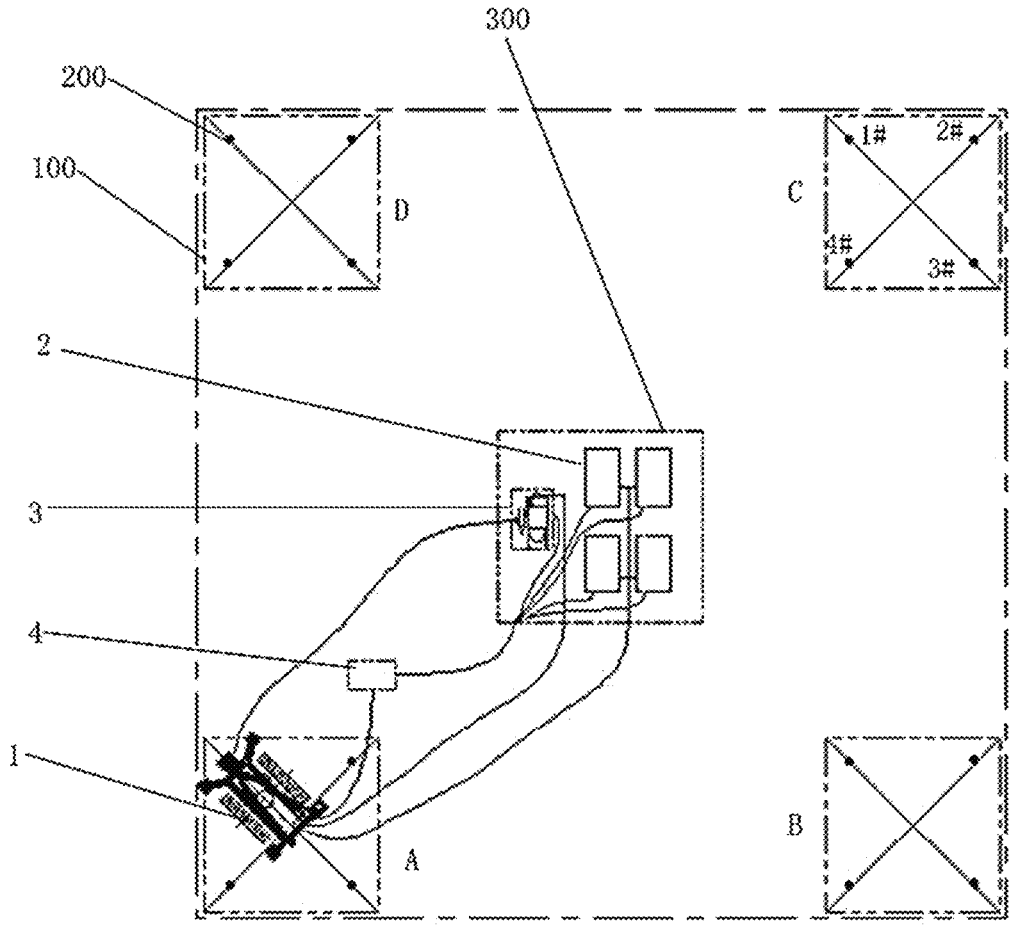
FIG. 1 is a schematic view of the modular distribution of a self-moving modular drilling device on a drilling platform according to an embodiment of the present application.

100 drilling platform
200 hole position
300 fixing and mounting region
1 hydraulic drilling unit
101 track mechanism
102 bridge
1021 beam
1022 stringer
1023 reinforcing plate
1024 taper pin
1025 taper shoe
1026 first connector
103 swivel assembly
1031 fixed portion
1032 rotating portion
1033 locking mechanism
104 chassis
105 drill boom
106 adjustment lever
107 telescopic rod
108 drive mechanism
109 drill rod
110 hydraulic system module
111 power system module
2 air compressor unit
201 multi-way connector
2011 main input interface
2012 main output interface
2013 secondary input interface
2014 mixing chamber
2015 oil mist interface
2016 secondary input channel
202 compressed air conduit
203 air compressor module
204 air compressor power module
3 dust removal unit
301 dust collection cover
302 dust remover
303 air duct
4 operation bench
5 oil mist lubricator
6 three-way joint
601 air intake interface
7 support leg

DETAILED DESCRIPTION

In the description of the present application, terms "joined", "connected" and "secured" are to be understood in a broad sense unless otherwise expressly specified and limited. For example, the term "connected" may refer to "securely connected", "detachably connected" or "integrated", may refer to "mechanically connected" or "electrically connected" or may refer to "connected directly", "connected indirectly through an intermediary" or "connected inside two components" or "interaction relations between two components". For those of ordinary skill in the art, specific meanings of the preceding terms in the present application may be construed according to specific circumstances.

In the present application, unless otherwise expressly specified and limited, when a first feature is described as "on" or "below" a second feature, the first feature and the second feature may be in direct contact or be in contact via another feature between the two features instead of being in direct contact. Moreover, when the first feature is described as "on", "above" or "over" the second feature, the first feature is right on, above or over the second feature, or the first feature is obliquely on, above or over the second feature, or the first feature is simply at a higher level than the second feature. When the first feature is described as "under", "below", or "underneath" the second feature, the first feature is right under, below, or underneath the second feature, or the first feature is obliquely under, below, or underneath the second feature, or the first feature is simply at a lower level than the second feature.

In the description of the present application, it should be noted that orientations or position relations indicated by terms such as "above", "below", "right" and the like are based on orientations or position relations shown in the drawings. These orientations or position relations are intended only to facilitate and simplify the operation, and not to indicate or imply that a device or element referred to must have such specific orientations or must be configured or operated in such specific orientations. Thus, these orientations or position relations are not to be construed as limiting the present application. In addition, the terms "first" and "second" are used only to distinguish between descriptions and have no special meaning.

Embodiment One

Figure 2:
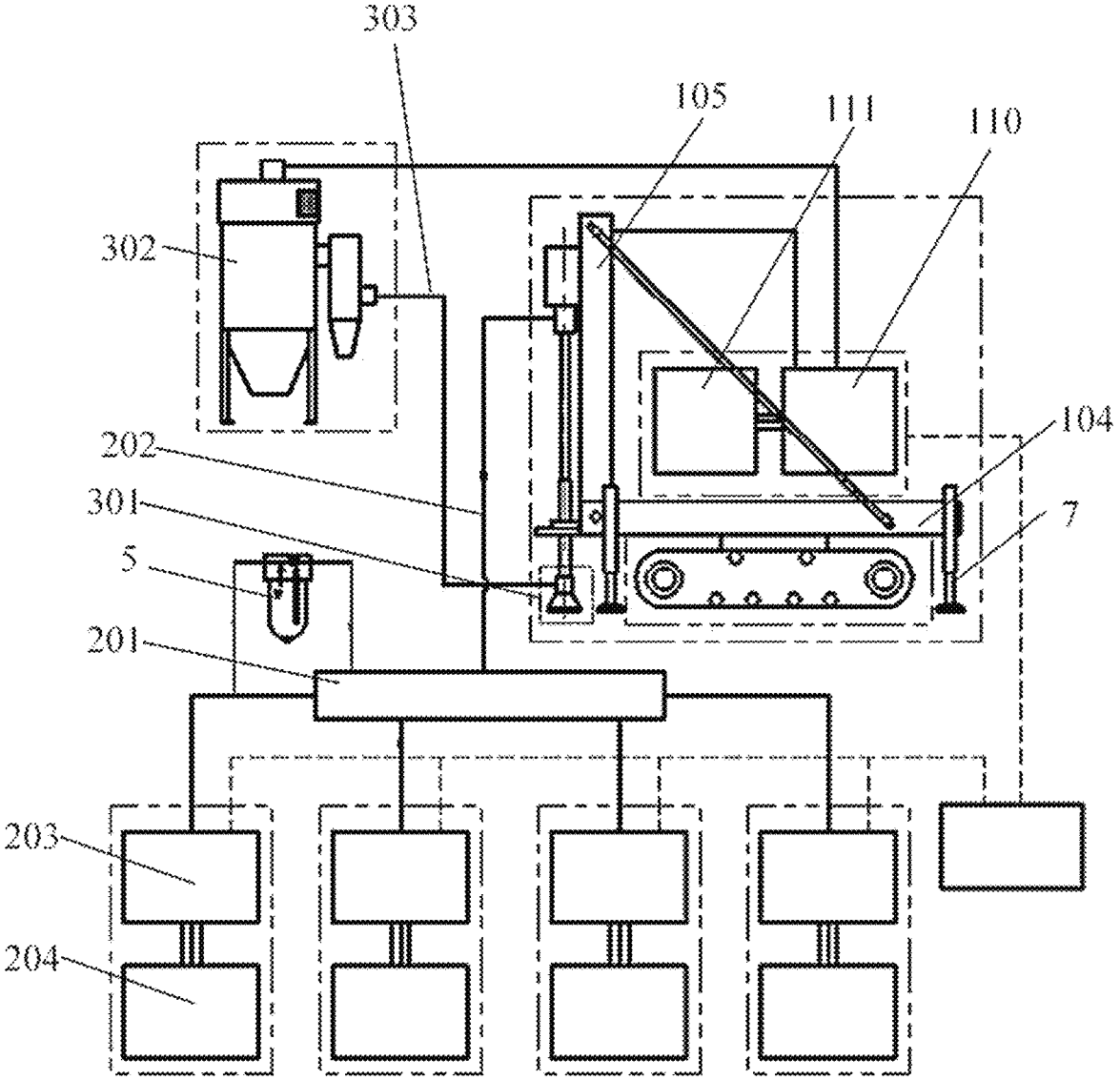
FIG. 2 is a schematic view of an overall structure of a self-moving modular drilling device according to an embodiment of the present application.

First, this embodiment provides a drilling device. The drilling device is a self-moving modular drilling device. As shown in FIGS. 1 and 2, the drilling device includes a hydraulic drilling unit 1, multiple air compressor units 2, a dust removal unit 3 and an operation bench 4. The hydraulic drilling unit 1 can moving among multiple drilling platforms 100 and among multiple hole positions 200 on the drilling platforms 100, and perform a drilling operation. Multiple air compressor units 2 are disposed in a fixing and mounting region 300 that is among the multiple drilling platforms 100. Compressed air outputted by the multiple air compressor units 2 flows jointly through a multi-way connector 201 and then is transmitted to the hydraulic drilling unit 1 through a compressed air conduit 202. The dust removal unit 3 includes a dust collection cover 301 and a dust remover 302. The dust collection cover 301 is disposed at ground apertures of the hole positions 200. The dust remover 302 is disposed in the fixing and mounting region 300. The dust collection cover 301 and the dust remover 302 are connected through an air duct 303. The operation bench 4 is separately communicatively connected to the hydraulic drilling unit 1, the air compressor units 2 and the dust remover 302 for communication and control. In an embodiment, the operation bench 4 is connected to a hydraulic drive mechanism in the hydraulic drilling unit 1 so as to control the starting and stopping of the hydraulic drive mechanism, is connected to a power mechanism in the air compressor unit 2 to control the generation and output of the compressed air, and is connected to a drive mechanism of the dust remover 302 to control the starting and stopping of the dust remover. Generally, the preceding connections of the operation bench 4 is performed in a wireless or wired manner. In an embodiment, the connection of the operation bench 4 is in a wireless remote control manner, so as to perform remote control. In this manner, the operation bench 4 can move freely, and an appropriate position is selected for operation according to requirements of a construction site. For example, the operation bench 4 is placed at an optimal angular position where a drilling machine is operated for drilling.

The self-moving modular drilling device provided in the present application is configured with the dust removal unit 3 so that the drilling construction site is free from dust pollution, thereby improving the working environment of staff. The dust remover 302 may be a cyclone dust remover and include a cyclone barrel mounted on a dust removal bracket, a filter element, a blower, a hydraulic motor and the like, where the hydraulic motor is configured to drive the blower.

The present application provides the self-moving modular drilling device. The drilling device is modularly arranged. The hydraulic drilling unit 1 separately disposed on the drilling platform 100 performs independent moving and drilling. The air compressor units 2 and the dust remover 302 are disposed among multiple drilling platforms 100. When the hydraulic drilling unit 1 moves and performs drilling, after positions of the air compressor units 2 and the dust remover 302 are reasonably arranged in advance, the air compressor units 2 and the dust remover 302 keep stationary, thereby reducing the number of unit modules that need to be moved and transferred for each time of drilling. Compared with the case where the whole drilling device is disposed on the drilling platform 100 in the related art, the modular drilling device in the present application is transported to mountainous areas or other drilling construction sites with a rock foundation and poor traffic in the form of modularization or split components, and modules after split and transportation are mounted on the site, arranged at pre-planned positions, and connected through the air duct 303 or a cable manner or a wireless manner so as to construct the drilling device so that quick assembly can be achieved, thereby greatly improving the drilling efficiency and reducing the manual labor intensity, especially accelerating the movement efficiency among the drilling platforms 100. In this embodiment, the hydraulic drilling unit 1 is connected to the air compressor units 2 through the compressed air conduit 202, and the dust collection cover 301 and the dust remover 302 in the dust removal unit 3 are connected through the air duct 303. The operation bench 4 is individually wired or wirelessly connected to the hydraulic drilling unit 1, the air compressor units 2 and the dust remover 302 separately, and positions are not limited so that each unit module can be individually hoisted and transported, and each unit module of the drilling device can be quickly disassembled and assembled at the construction site, thereby solving the problem that the drilling device is inconvenient to transport due to its large volume and weight.

Figure 3:
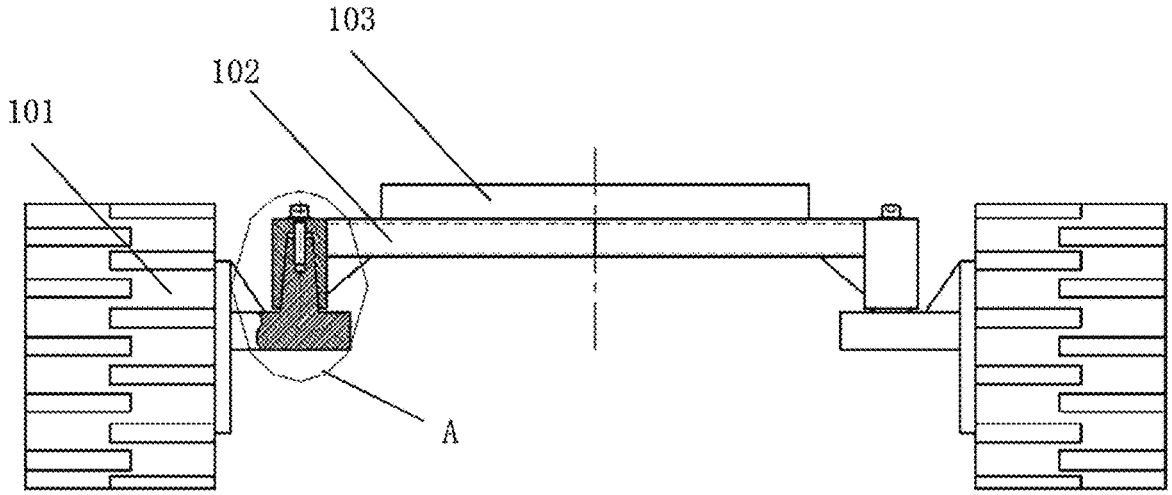
FIG. 3 is a schematic view of part of a structure of a hydraulic drilling unit in a self-moving modular drilling device according to an embodiment of the present application.

As shown in FIG. 3, the hydraulic drilling unit 1 includes a drilling chassis module, a drill boom assembly module and a hydraulic drive module. The drilling chassis module includes two track mechanisms 101, one bridge 102 and one swivel assembly 103. The two track mechanisms 101 are symmetrically arranged at two ends of the bridge 102. The swivel assembly 103 is rotatable connected to the bridge 102 and disposed in the middle of the two track mechanisms 101. The drill boom assembly module and the hydraulic drive module are mounted on the swivel assembly 103 separately.

As shown in FIG. 3, the two track mechanisms 101 are configured to be a moving mechanism of the hydraulic drilling unit 1, can move on the drilling platforms 100 for performing drilling at each hole position 200 or move among the drilling platforms 100. Since multiple hole positions 200 on the drilling platforms 100 are generally arranged circumferentially, the swivel assembly 103 is provided so that the moving and rotation of the drill boom assembly module relative to the track mechanisms 101 can be achieved. Since the space of the drilling platforms 100 is limited, the rotation of the swivel assembly 103 is more conducive to the improvement of the rotation efficiency and faster switching between different hole positions 200.

In an embodiment, each air compressor unit 2 includes at least one air compressor module 203 and at least one air compressor power module 204, where the air compressor power module 204 is configured to drive the air compressor module 203 to generate and output the compressed air.

In some embodiments, the at least one air compressor module 203 and the at least one air compressor power module 204 in each air compressor unit 2 may be connected in a one-to-one correspondence, or one air compressor module 203 may be connected to at least two air compressor power modules 204, or one air compressor power module 204 may drive multiple air compressor modules 203 to work. To facilitate hoisting and transferring, in the first case, the air compressor module 203 and the air compressor power module 204 are separately fixedly mounted on two different fixed frames that are detachably connected. In an embodiment, a plug-in positioning mechanical locking connection manner is used between the two fixed frames. In the second and third cases, at least two air compressor power modules 204 are separately assembled and mounted on one fixed frarne, and multiple air compressor modules 203 are assembled and mounted on one fixed frame; after separately transported to the construction site, the fixed frames are assembled and mounted through corresponding driving objects, thereby improving the installation efficiency and hoisting efficiency. In an embodiment, generally, the total weight of each fixed frame does not exceed 200 KG, and hoisting members are separately provided at the tops of the fixed frames, so as to be better compatible with a variety of different hoisting manners, such as manual hoisting, livestock, cableway and/or small-sized rotor wing unmanned aerial vehicle handling. In an embodiment, the air compressor module 203 uses a screw air compressor, and the air compressor power module 204 uses a V-type double-cylinder diesel engine and a small-sized high-speed diesel engine as a prime mover so that the power efficiency is higher and the fuel safety is better, which is suitable for field forest operation and is not easy to cause mountain fire. During the drilling construction, multiple air compressor modules 203 are placed on a flat ground in the fixing and mounting region 300, arranged side by side, and connected in parallel. The number of air compressor modules 203 may be determined according to the drilling size and the drilling device power required for construction.

In an embodiment, the self-moving modular drilling device provided in the present application further includes an oil mist lubricator 5 and a three-way joint 6. A first port of the three-way joint 6 communicates with the multi-way connector 201, a second port of the three-way joint 6 communicates with an output end of the air compressor module 203, and a third port of the three-way joint 6 is used as an air intake interface 601. The oil mist lubricator 5 communicates between the air intake interface 601, and an oil mist interface 2015 that is disposed on the multi-way connector 201.

Figure 4:
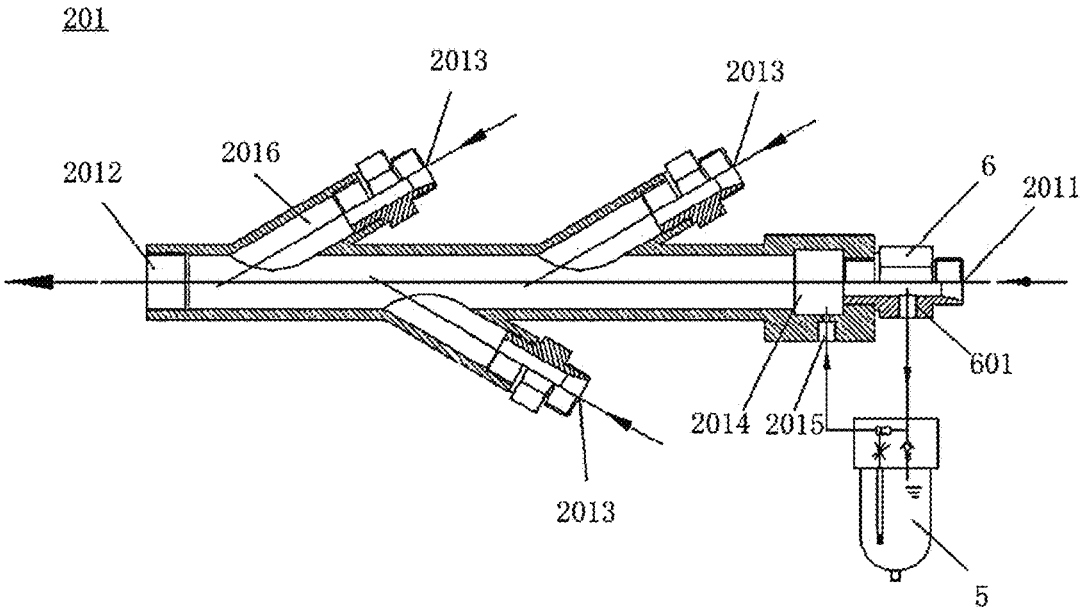
FIG. 4 is a structural view of a multi-way connector in a self-moving modular drilling device according to an embodiment of the present application.

FIG. 4 is a structural view of the multi-way connector 201. In the figure, a direction of an arrow is an airflow direction. The multi-way connector 201 is disposed between multiple air compressor modules 203 and a hydraulic impactor of the hydraulic drilling unit 1. The multi-way connector 201 includes a cylindrical body on which a main channel of the compressed air is provided. Two ends of the main channel are separately a main input interface 2011 and a main output interface 2012 of the compressed air. Multiple secondary input interfaces 2013 are disposed on the main channel in sequence along an axial direction. A mixing chamber 2014 whose inner diameter greater than that of the main channel is disposed on the main channel between the secondary input interfaces 2013 adjacent to the main input interface 2011, and the main input interface 2011. The mixing chamber 2014 is provided with the oil mist interface 2015. The main input interface 2011 and multiple secondary input interfaces 2013 are separately connected to the multiple air compressor modules 203. The main output interface 2012 is connected to the impactor. The first port of the three-way joint 6 communicates with the main input interface 2011, the second port of the three-way joint 6 communicates with the mixing chamber 2014, and the third port of the three-way joint 6 is used as the air intake interface 601. The oil mist lubricator 5 communicates between the air intake interface 601, and the oil mist interface 2015. The secondary input interfaces 2013 communicate with the main channel through a secondary input channel 2016. An inner diameter of the secondary input channel 2016 is less than an inner diameter of the main channel, and a compressed air input direction in the secondary input channel 2016 forms an included angle B with a compressed air input direction in the main channel, where the included angle B is less than 90°. In an embodiment, the included angle B is equal to 30°. Two adjacent secondary input channels 2016 are spaced apart along the axial direction of the main channel and staggered along a circumferential direction. The main input interface 2011 and the main output interface 2012 are separately arranged coaxially with the main channel. An inner diameter of the main output interface 2012 is greater than the inner diameter of the main channel. An inner diameter of the first port of the three-way joint 6 is less than the inner diameter of the main channel. An inner diameter of the air intake interface 601 is equal to an inner diameter of the oil mist interface 2015. A necking channel is provided between the oil mist interface 2015 and the mixing chamber 2014 so that the oil mist mixed gas enters the mixing chamber 2014 under the action of a negative pressure and forms a turbulent flow in the mixing chamber 2014 so as to be fully mixed with the compressed air. Multiple flows of compressed air enter the main channel through respective secondary input channels 2016, and the airflow in the secondary input channels 2016 has less interference to the compressed air in the main channel, thereby reducing the pressure loss of the compressed air in the main channel and facilitating the flow control of the compressed air.

Figure 6:
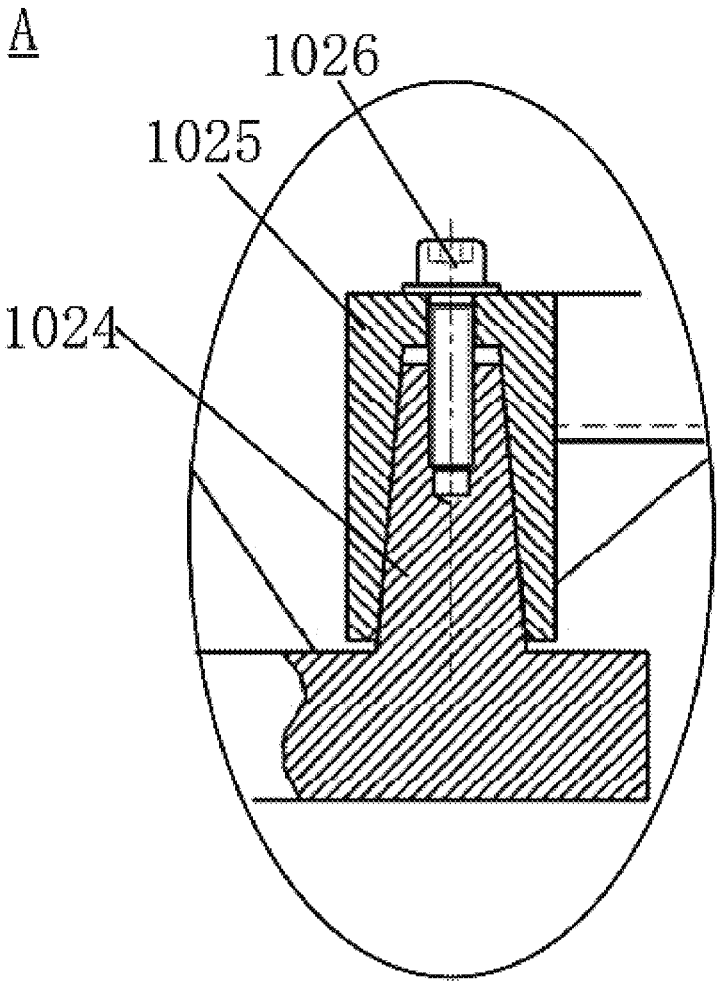
FIG. 6 is an enlarged view of a region A in FIG. 3.

Referring to FIGS. 3 and 6, first mounting portions are provided at two ends of the bridge 102 separately, the track mechanisms 101 include second mounting portions, and the first mounting portions and the second mounting portions are detachably connected. The bridge 102 and the track mechanisms 101 are detachably connected to each other so that the bridge 102 and the track mechanisms 101 can be assembled after respectively transported, and the disassembly efficiency is high.

One of the first mounting portion or the second mounting portion is provided with a taper pin 1024, and the other one of the first mounting portion or the second mounting portion is provided with a taper shoe 1025, where the taper pin 1024 and the taper shoe 1025 are separately provided with central connecting holes, the taper pin 1024 is inserted into the taper shoe 1025, and a first connecting member 1026 is mounted in the two central connecting holes.

Figure 5:
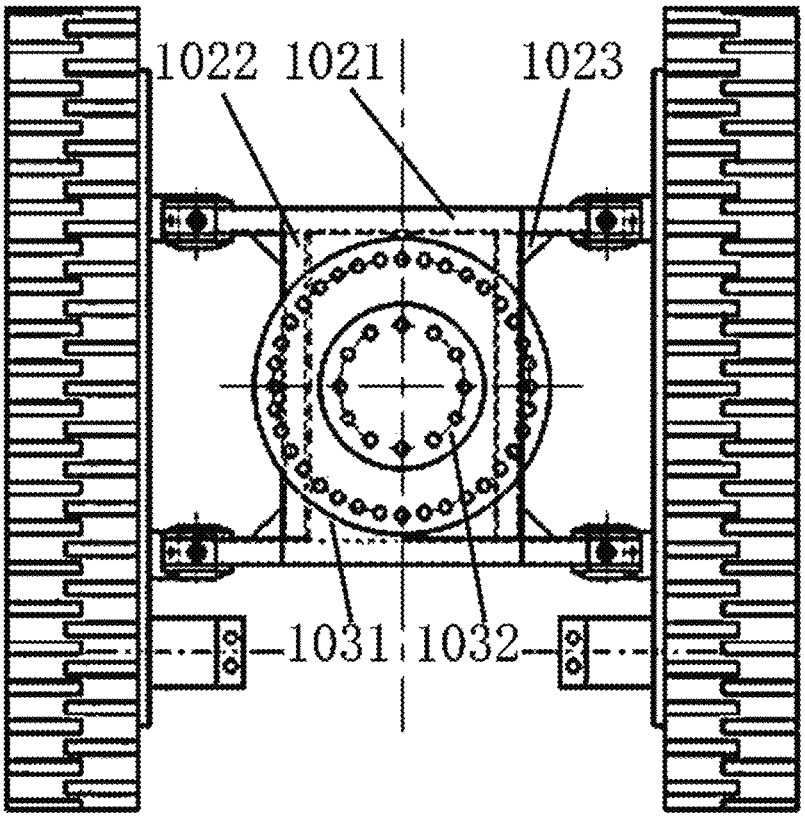
FIG. 5 is a structural view of a bridge in a self-moving modular drilling device according to an embodiment of the present application.

In some embodiments, to enhance the strength of the bridge 102 and reduce the weight of a single split component, as shown in FIG. 5, the bridge 102 includes at least two beams 1021 and two stringers 1022. The two beams 1021 are parallel to each other, the two stringers 1022 are parallel to each other, and the beams 1021 are perpendicular to the stringers 1022. The first mounting portions are separately provided at two ends of the beam 1021, two ends of the stringer 1022 are connected to the two beams 1021, respectively, and a reinforcing plate 1023 with a triangular structure is provided at a connection portion, so as to effectively prevent the beams 1021 and the stringers 1022 from being deformed under a force.

In an embodiment, as shown in FIGS. 3 and 6, the central connecting hole is a threaded hole, the first connecting member 1026 is a bolt or screw, and the first connecting member 1026 is threaded into the central connecting hole so as to axially fix the taper pin 1024 to the taper shoe 1025 to prevent the taper pin 1024 from disengaging from the taper shoe 1025 due to uneven ground and undulating track supports during moving. In an embodiment, the taper pin 1024 and the taper shoe 1025 are in a manner that facilitates quick plug-in positioning, simple hole alignment, central alignment after mounted in place, and quick disassembly, thereby improving the overall disassembly and assembly efficiency of the drilling device. A mating connection of the taper pin 1024 and the taper shoe 1025 can withstand the torsion when two sides of the track mechanism 101 move out of phase.

In an embodiment, the drill boom assembly module includes a chassis 104, a drill boom 105, an adjustment rod 106, a telescopic rod 107 and a drive mechanism 108. The chassis 104 is fixedly connected to the swivel assembly 103 and rotatable with the swivel assembly 103. A first end of the drill boom 105 is a fixed end, a second end of the drill boom 105 is an adjustment end, the fixed end is hinged with the chassis 104, a top end of the adjustment rod 106 is hinged with the adjustment end, a bottom end of the adjustment rod 106 is slidably connected to the chassis 104, a top end of the telescopic rod 107 is hinged with the adjustment end, a bottom end of the telescopic rod 107 is hinged with the chassis 104, and the drive mechanism 108 can drive the telescopic rod 107 to move telescopically.

Figure 7:
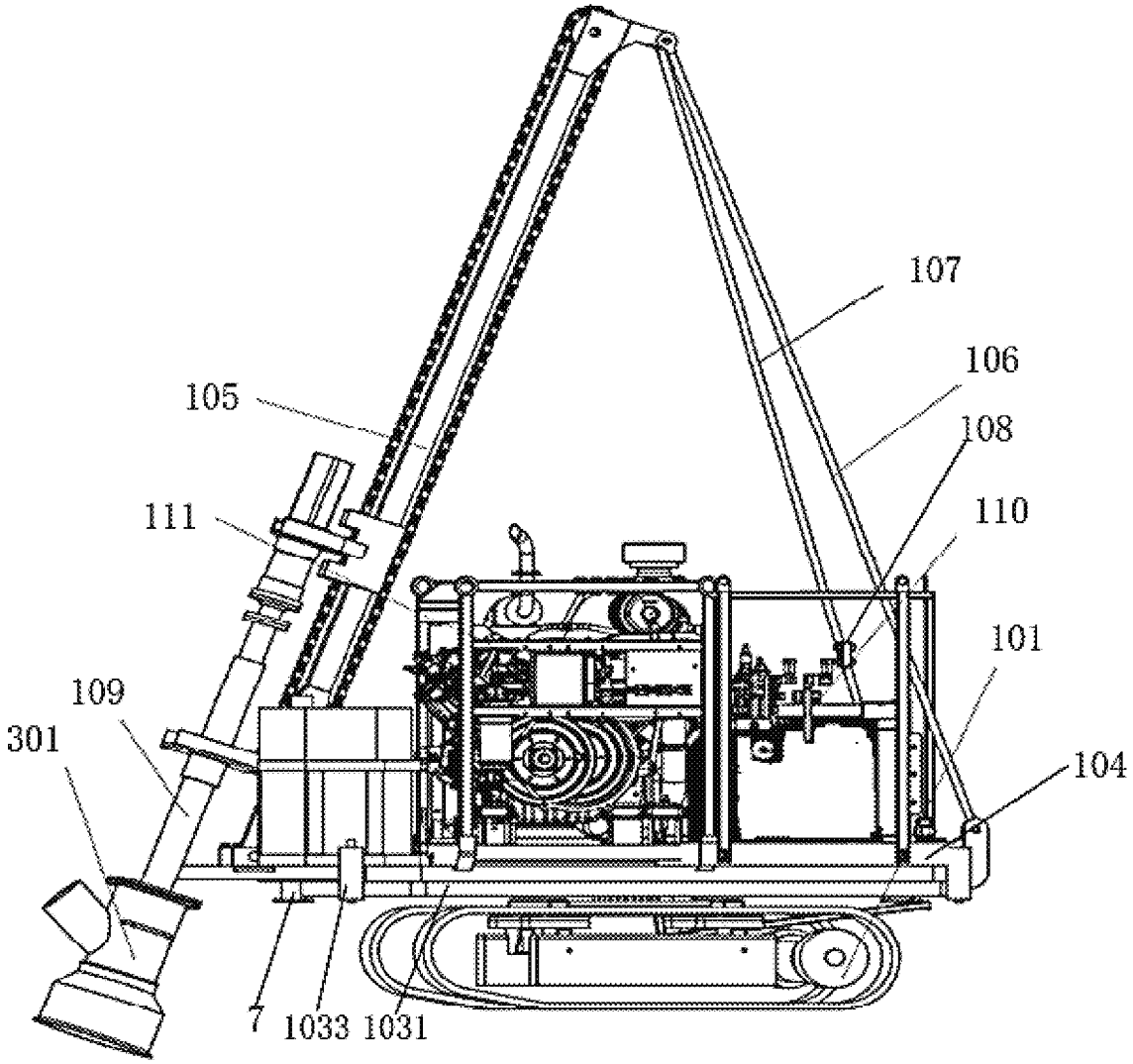
FIG. 7 is a schematic view of components of a drill boom assembly module and a hydraulic drive module in a self-moving modular drilling device according to an embodiment of the present application.
Figure 8A:
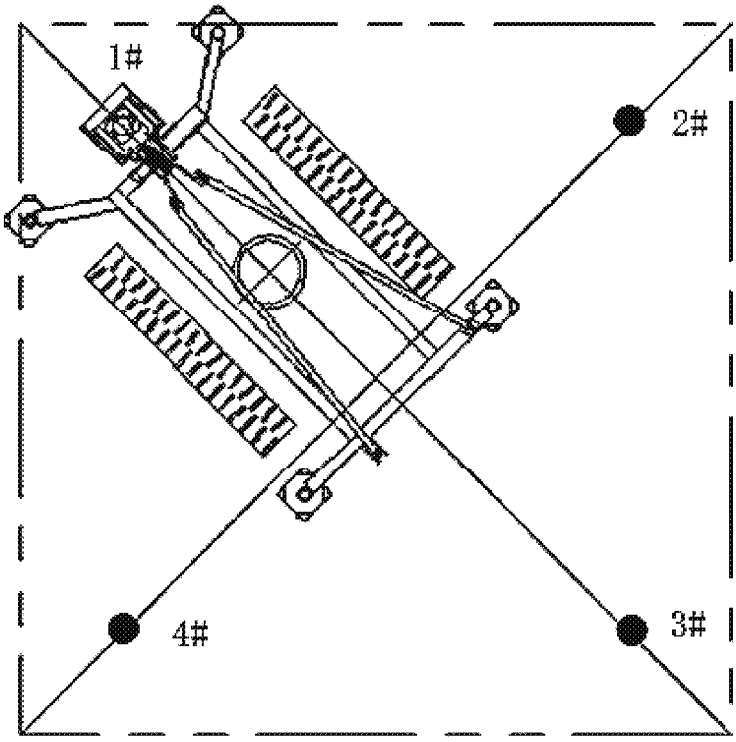
FIGS. 8A to 8G are schematic views of a moving route of a hydraulic drilling unit in a drilling construction method for an electric power iron tower foundation according to an embodiment of the present application.
Figure 8B:
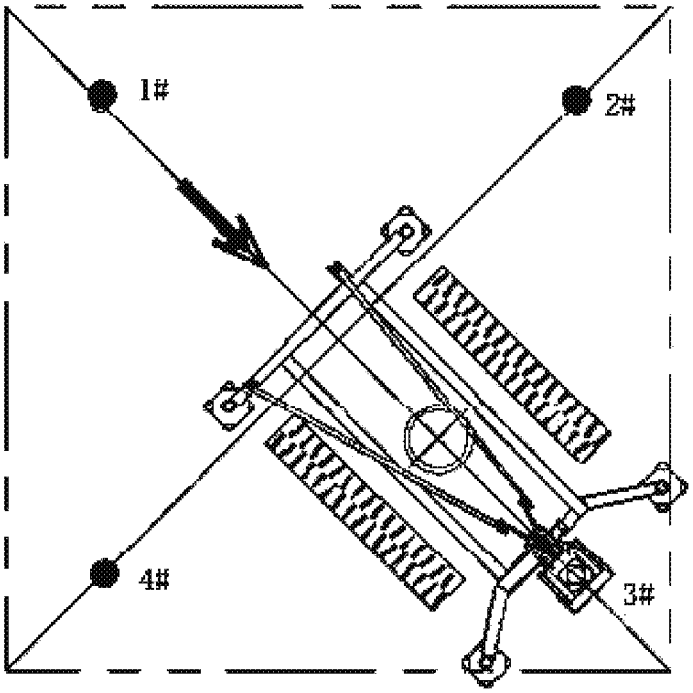
Figure 8C:
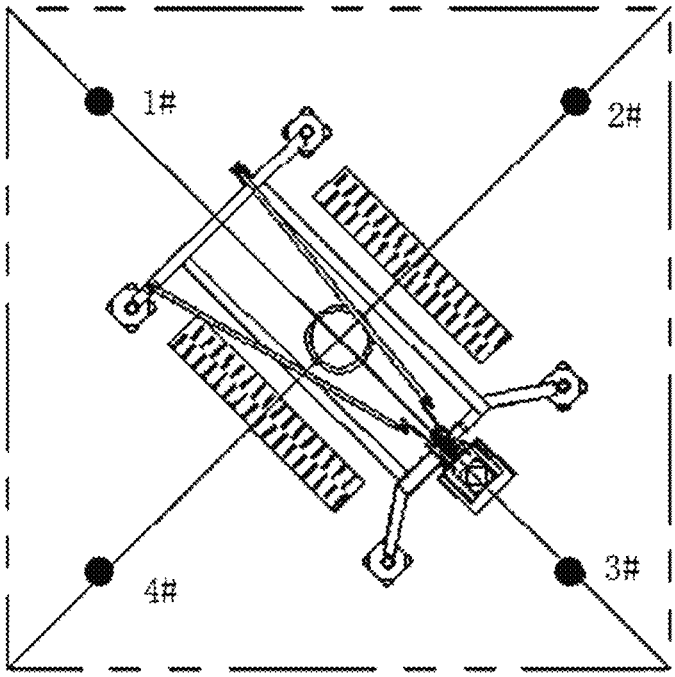
Figure 8D:
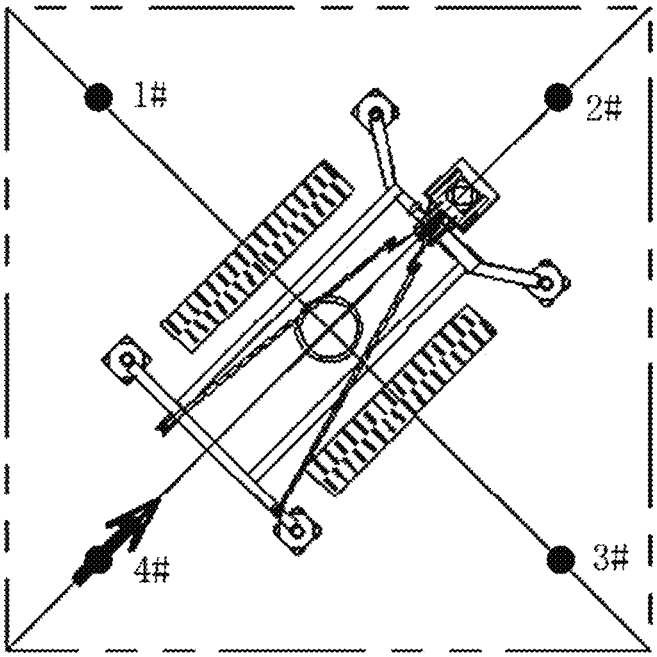
Figure 8E:
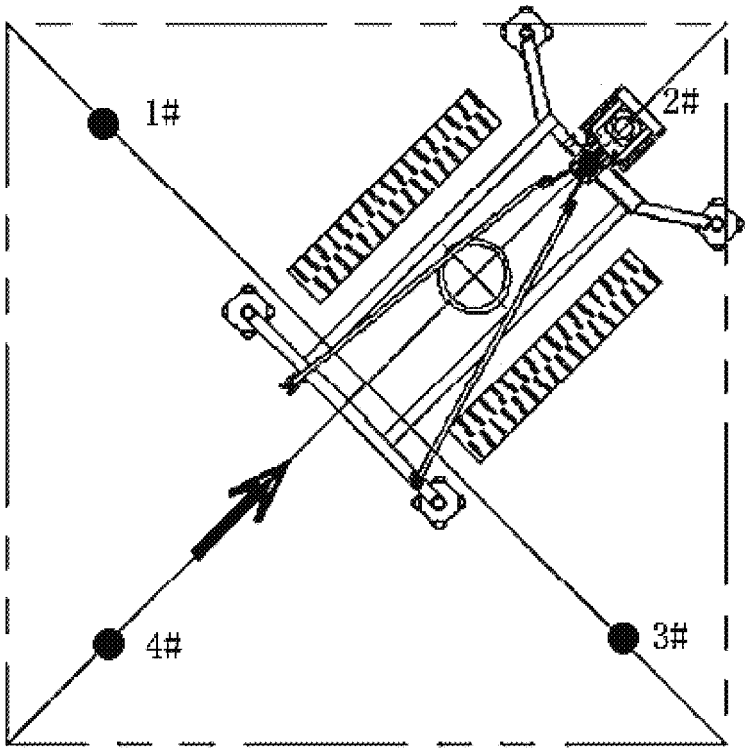
Figure 8F:
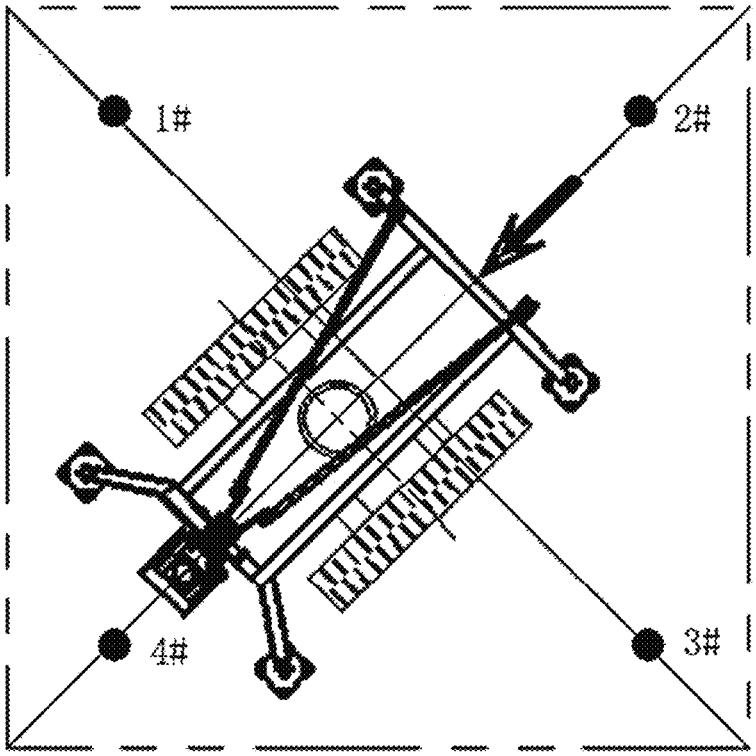
Figure 8G:
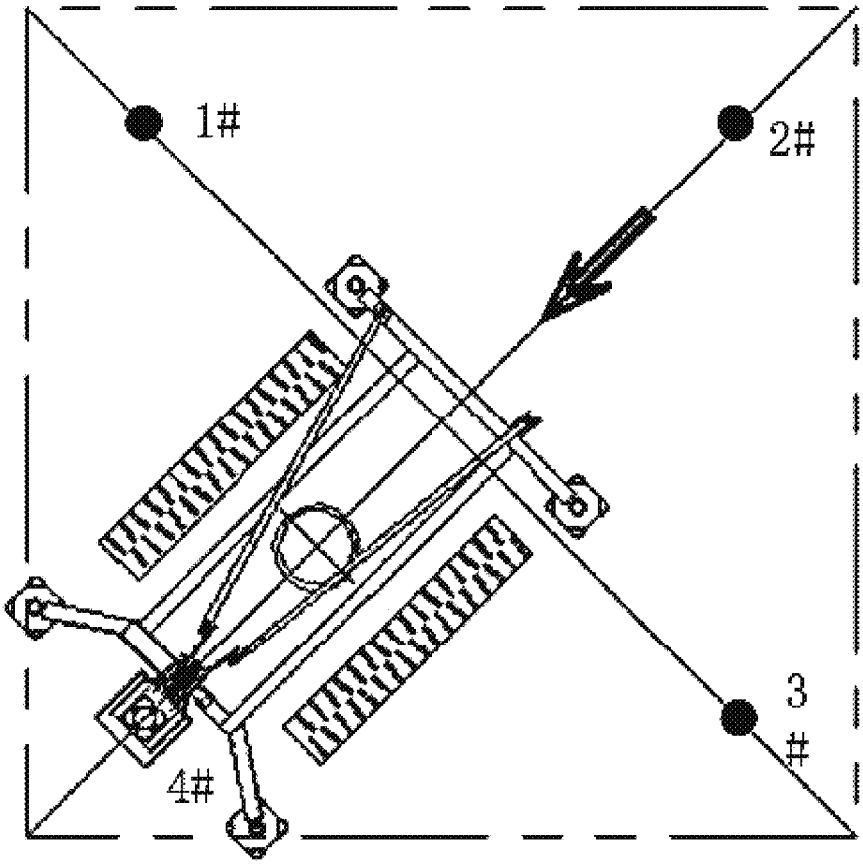

In conjunction with FIGS. 2 and 7, the drive mechanism 108 may be a separate hydraulic drive mechanism or may be an actuator connected to an output end of the hydraulic drive module. A sliding block is provided at the bottom end of the adjustment rod 106 and slidably connected to the chassis 104. When the adjustment rod 106 slides, the adjustment end of the drill boom 105 rotates relative to the fixed end so as to continuously adjust the angle of the drill boom 105. A drill rod 109 is connected to an end of the drill boom 105, and the drill rod 109 is driven by the drill boom 105 to rotate by a certain angel so that a drill bit on the drill rod 109 is aligned with the hole position 200 so as to perform drilling. In an embodiment, a latch may be provided on the sliding block to latch the sliding block to the chassis 104. As shown in FIG. 7, the dust collection cover 301 is sleeved on the drill rod 109, the dust collection cover 301 is placed at the ground aperture during construction, and the impactor impacts and breaks rock through the drill bit and completes drilling in cooperation with the propulsion and rotation of the drill rod 109 of the hydraulic drilling machine. In this process, the air discharged through an air hole at a front end of the drill bit blows the generated rock debris out of the hole, the dust collection cover 301 provided at the hole position and the dust remover 302 connected to the dust collection cover 301 sucks the slag and rock debris removed from the hole into the dust remover 302, and large particles are separated and fall down so that the drifting dust is easily filtered and collected. The dust collection cover 301 is non-fixed, and a guide ring is provided in the dust collection cover 301 so that the dust collection cover 301 is always at the hole position without interfering with deslagging at the hole, thereby ensuring the dust collection effect.

In an embodiment, the hydraulic drive module is provided with at least three hydraulic output interfaces, where each hydraulic output interface is provided with a quick-plug joint, at least one hydraulic output interface is connected to the two track mechanisms 101 to drive the two track mechanisms 101 to move, at least one hydraulic output interface is connected to the drill boom assembly module to drive the drill hit connected to the drill boom 105 to perform drilling, and at least one hydraulic output interface is connected to the dust remover 302.

As shown in FIGS. 2 and 7, the hydraulic drive module provides a hydraulic driving force for drilling construction, a dust removal blower and track moving of the drilling machine, is also used as a counterweight for stabilizing the drilling machine, and has the relatively large overall mass. To facilitate handling, the hydraulic drive module includes a hydraulic system module 110 and a power system module 111, where the power system module 111 is close to the drill boom 105 and arranged at the front, and the hydraulic system module 110 is arranged at the rear, where the front and rear refer to left and right directions in FIG. 7. The hydraulic system module 110 is provided with at least three hydraulic output interfaces; the power system module 111 is drivingly connected to the hydraulic system module 110 and configured to provide power to the hydraulic system module 110. The power system module 111 has a total weight of less than 200 kg, uses a V-type double-cylinder diesel engine as a prime mover, and can be started in conjunction with an electric starter, an engine cooling system, an engine starting, speed regulation and self-check and self-control system, an external storage battery and an external diesel tank (barrel), so as to provide power for the hydraulic system module 110. The hydraulic system module 110 is composed of a hydraulic oil pump, a driving pulley, a hydraulic oil tank, an air-cooled temperature-controlled oil cooler and a control valve group, provides a hydraulic driving power for the drilling machine, and has a total weight of less than 200 kg; and the power system module 111 is drivingly connected to the hydraulic system module 110 through a belt, a coupling or other components. The hydraulic system module 110 is provided with multiple hydraulic output interfaces, where one hydraulic output interface communicates with the dust remover 302 of the dust removal unit 3, and the remaining hydraulic output interfaces may communicate with other devices according to field conditions and be configured to drive other hydraulic devices so that one hydraulic drive module may be used by multiple hydraulic devices at the same time. To ensure the expandability of a hydraulic output function, one hydraulic output interface of the hydraulic system module 110 is connected to the drill boom assembly module, so as to provide a hydraulic driving force for drilling construction of the drill boom assembly module; and one hydraulic output interface of the hydraulic system module 110 is connected to at least one of a hydraulic power generation electric welding machine, a hydraulic winch, or a hydraulic wrench. The hydraulic power generation electric welding machine may output alternating current or direct current for electric welding and may be used as an on-site electric welding tool, a lighting tool, a power tool or the like. When the drilling machine moves up a steep slope, the hydraulic winch hydraulically pulls the drilling machine for auxiliary climbing and acts as a safety rope to prevent the drilling machine from sliding down or overturning so that one hydraulic drive module may be used by multiple hydraulic devices at the same time, thereby enhancing the expandable function of the hydraulic system module 110 and achieving that one machine has multiple functions and purposes. The hydraulic output interface is provided with the quick-plug joint and can be quickly, easily and conveniently disassembled.

In an embodiment, the swivel assembly 103 includes a fixed portion 1031, a rotating portion 1032 and a locking mechanism 1033, where the rotating portion 1032 is rotatably disposed on the fixed portion 1031, the locking mechanism 1033 is capable of unlocking or locking the rotating portion 1032 relative to the fixed portion 1031, the fixed portion 1031 is fixed on the bridge 102, and the rotating portion 1032 is fixedly connected to the chassis 104. At a ±180 rotational position of the chassis 104, the locking mechanism 1033 is configured to lock and unlock the position of the chassis 104 after the chassis 104 rotates into position.

In an embodiment, a swivel center of the swivel assembly 103 is arranged at a center of the bridge 102, the chassis 104 may be separated from the swivel assembly 103, and the swivel assembly 103 may drive the chassis 104 to rotate continuously by any angle. In the present embodiment, the fixed portion 1031 is fixed on the bridge 102, the rotating portion 1032 rotates relative to the fixed portion 1031, and the locking mechanism 1033 performs locking when rotating by ±180° and ±90°, thereby facilitating the alignment of the drill bit with the hole position 200, reducing the floor area to a certain extent, and reducing the workload of early excavation and leveling on the construction site. The locking mechanism 1033 can ensure the stability during drilling.

In an embodiment, the self-moving modular drilling device further includes a support mechanism. As shown in FIG. 7, the support mechanism includes a support baseplate and multiple support legs 7, where the support baseplate is fixedly mounted on the chassis 104, the drill boom assembly module and the hydraulic drive module are carried above the support baseplate, and the multiple support legs 7 are arranged at intervals on the support baseplate and supported on the drilling platforms 100.

To ensure that the hydraulic drilling unit 1 remains stable during drilling after moved into position, the chassis 104 is configured to be rectangular, and four adjustable support legs 7 are separately provided at four corners for supporting, positioning and leveling. After the modular drilling device is assembled in place at the construction site, the air compressor units 2 and the dust removal unit 3 no longer move, and only the hydraulic drilling unit 1 moves in sequence among positions of the drilling hole positions 200. After drilling is completed at one hole position 200, the drill impactor is retracted and disengaged from the dust collection cover 301. The support legs 7 are retracted, the tracks touch the ground to bear weight, the self-sealing quick-plug joint for driving the hydraulic pipeline of the dust remover 302 is temporarily disconnected, and the hydraulic drilling unit 1 is controlled by the remote control operation bench 4 to advance, retreat and turn. When the next construction hole position 200 is reached, the support legs 7 are lowered, the hydraulic pipeline of the dust remover 302 is reconnected after positioning and hole alignment, and drilling is started.

In some embodiments, four hole positions 200 are distributed in sequence on the drilling platform 100 and distributed at four angular positions of the rectangular drilling platform 100. The hydraulic drilling unit 1 is firstly suspended on the drilling platform 100 and moves to the first hole position 200 for drilling. At this time, the support legs 7 are supported on the drilling platform 100. After drilling, the support legs 7 are retracted, the swivel assembly 3 rotates by 180° and is locked. The track mechanism 101 retreats to the second hole position 200 at the diagonal position for drilling. After drilling, the support legs 7 are retracted, the track mechanism 101 advances to a center of the drilling platform 100, the support legs 7 support the drilling platform 100, the track mechanism 101 stops after rotating by 90° relative to the swivel assembly 3, the support legs 7 are retracted, and the track mechanism 101 moves to the third hole position 200 for drilling. After drilling, the support legs are retracted, and the track mechanism 101 retreats to the fourth hole position 200 for drilling. In the preceding drilling process, through the cooperation between the support legs 7 and the track mechanisms 101, the rotation of the track mechanisms 101 and the rotation of the chassis 104 above the swivel assembly 3 can be achieved separately, thereby solving the problems of large turning area and difficult turning of the track mechanisms 101.

Embodiment Two

Figure 9:
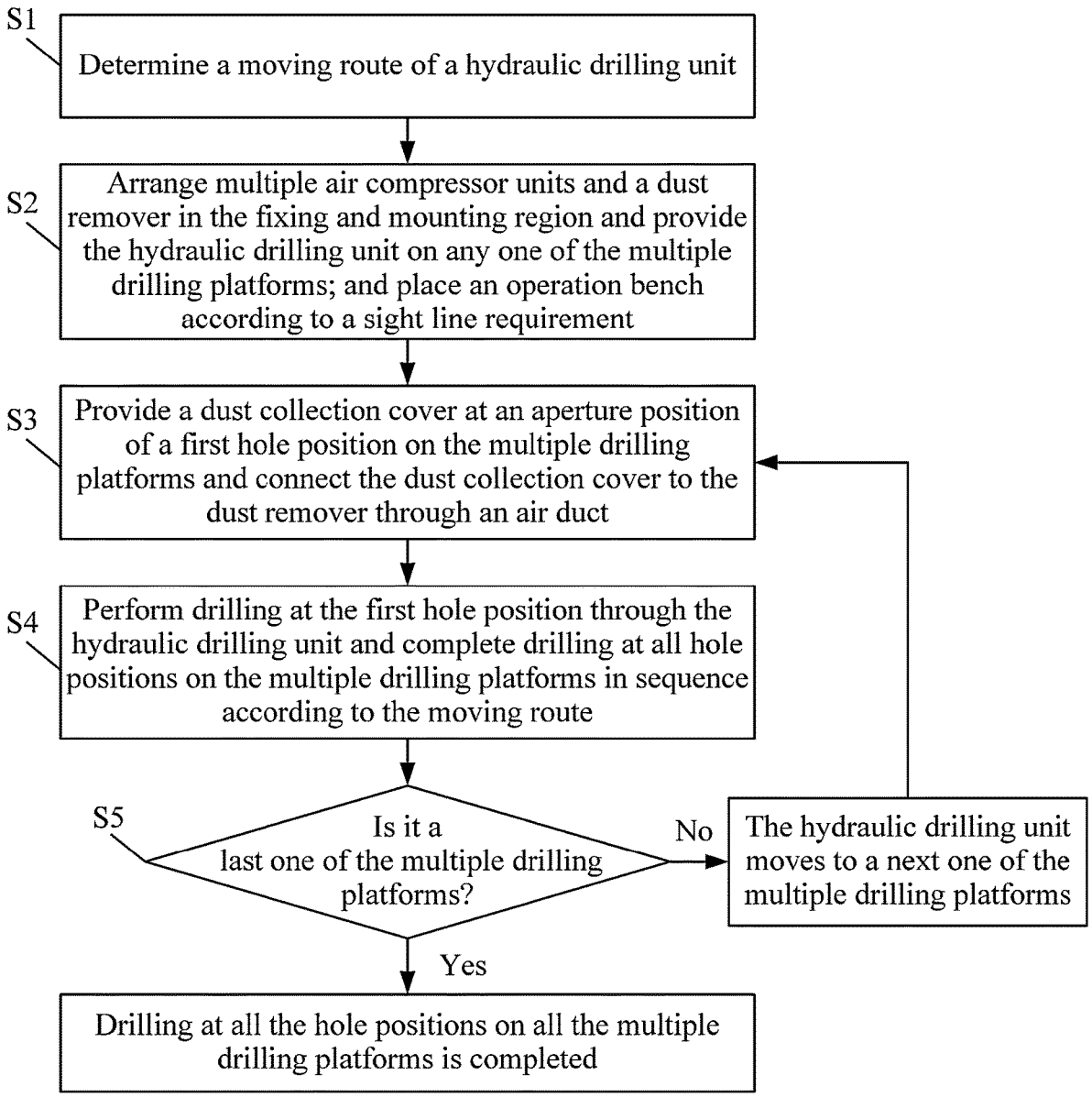
FIG. 9 is a flowchart of a drilling construction method for an electric power iron tower foundation according to an embodiment of the present application.
Figure 10:
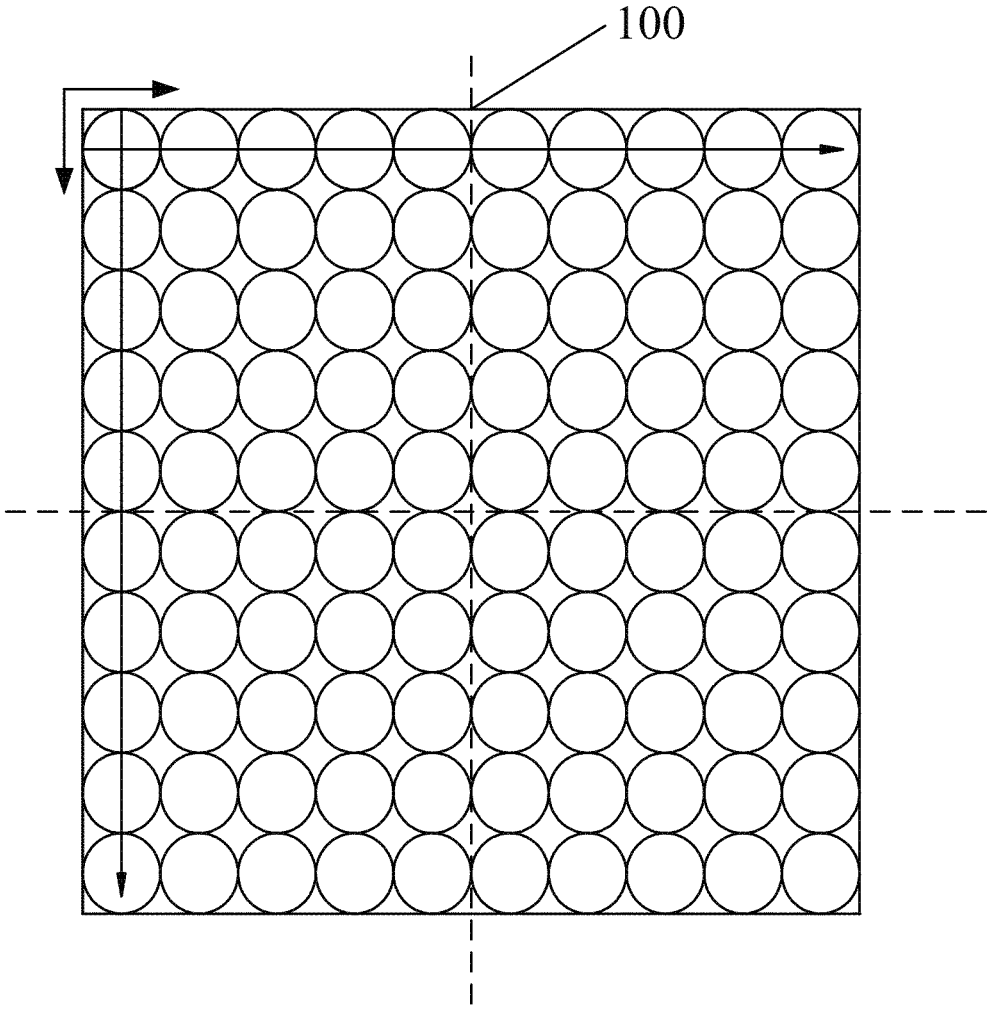
FIG. 10 is a schematic view of a drilling direction when a drilling operation on a drilling platform in a drilling construction method for an electric power iron tower foundation is performed according to an embodiment of the present application.
Figure 11:
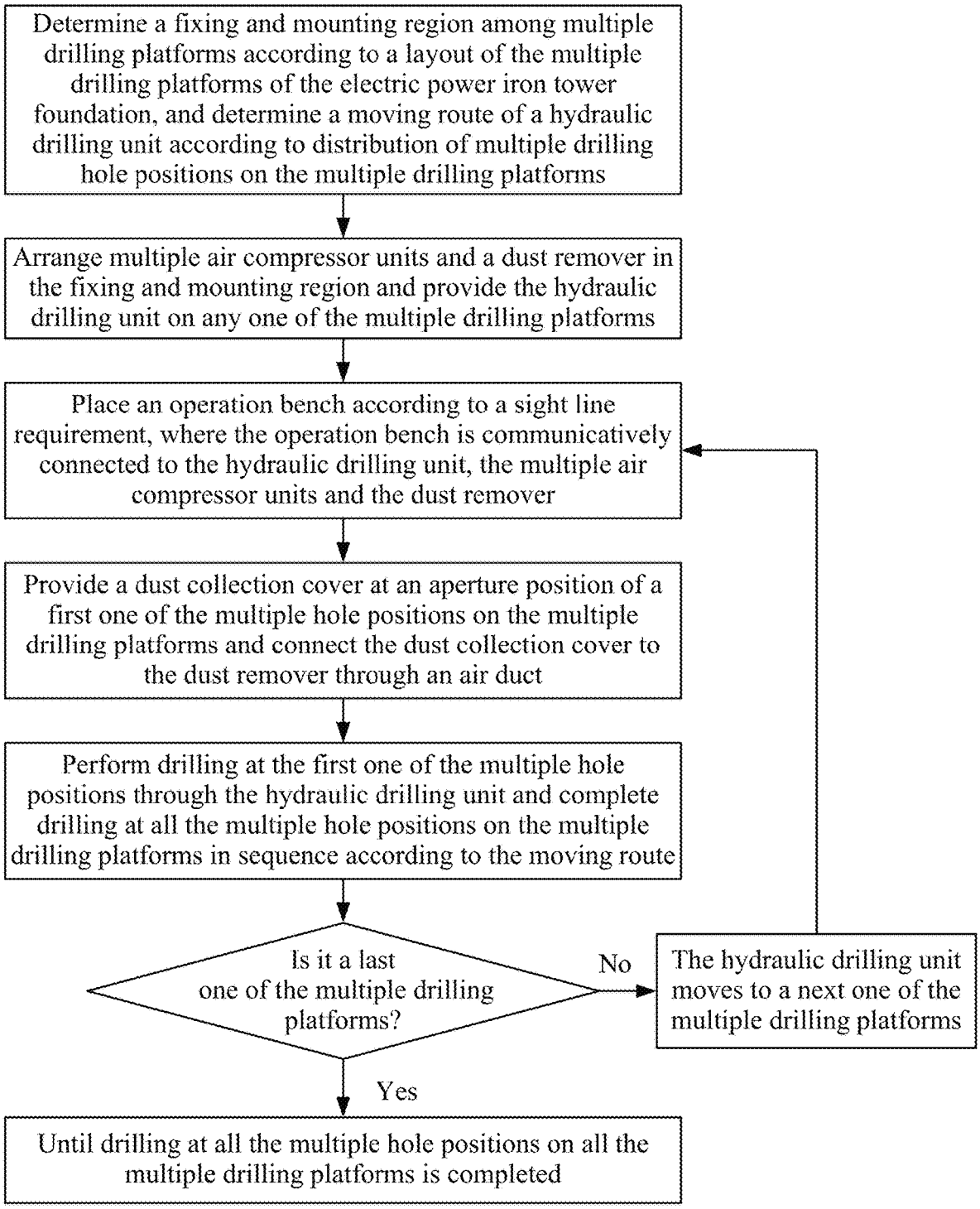
FIG. 11 is a flowchart of a drilling construction method for an electric power iron tower foundation according to another embodiment of the present application.

Based on the self-moving modular drilling device provided in embodiment one, this embodiment provides a drilling construction method for an electric power iron tower foundation. In conjunction with flows shown in FIGS. 9 and 10, the anchor rod hole construction of a transmission power iron tower foundation in a mountainous area is used as an example, and the drilling construction method includes the steps described below.

In S1, a fixing and mounting region 300 among multiple drilling platforms 100 is determined according to a layout of the multiple drilling platforms 100 of the electric power iron tower foundation and a moving route of a hydraulic drilling unit 1 is determined according to distribution of multiple drilling hole positions 200 on the multiple drilling platforms 100.

In S2, multiple air compressor units 2 and a dust remover 302 are arranged in the fixing and mounting region 300 and the hydraulic drilling unit 1 is provided on any one of the multiple drilling platforms 100; and an operation bench 4 is placed according to a sight line requirement, where the operation bench 4 is communicatively connected to the hydraulic drilling unit 1, the multiple air compressor units 2 and the dust remover 302.

In S3; a dust collection cover 301 is provided at an aperture position of a first one of the multiple hole positions 200 on the multiple drilling platforms 100 and the dust collection cover 301 is connected to the dust remover 302 through an air duct 303.

In S4, drilling is performed at the first one of the multiple hole positions 200 through the hydraulic drilling unit 1 and drilling at all the multiple hole positions 200 on the multiple drilling platforms 100 is completed in sequence according to the moving route.

In S5, whether it is a last one of the multiple drilling platforms is determined, based on a result that it is not the last one of the multiple drilling platforms, the hydraulic drilling unit 1 moves to a next one of the multiple drilling platforms 100, S3 is performed until drilling at all the hole positions 200 on all the drilling platforms 100 is completed, and based on a result that it is the last one of the multiple drilling platforms, drilling at the hole positions on all the drilling platforms is completed.

In an embodiment, in the preceding drilling construction method for an electric power iron tower foundation, the modular drilling device is used and reasonably arranged on the construction site, and only the hydraulic drilling unit 1 is disposed on the drilling platform 100 to perform self-moving and drilling so that the drilling construction flexibility is improved, and the drilling platform 100 is not limited by the drilling device and may be built according to actual requirements, thereby saving construction costs. The remaining modules, such as the dust remover and multiple air compressor units 2, do not move during the drilling construction, and the operation bench 4 may be arranged and moved according to requirements, thereby not only reducing the labor intensity of manual transportation of the device, but also improving the construction efficiency.

FIG. 1 is used as an example. Four tower foundation platforms A, B, C and D need to be constructed through casting at a construction site which is a square region occupying about 10 to 15 meters wide. As shown in FIGS. 8A to 8G, four anchor rod holes first, second, third, and fourth need to be drilled on each drilling platform 100, and corresponding four hole positions 200 are arranged in a quadrilateral manner in sequence. The moving route of the hydraulic drilling unit 1 is as follows: the hydraulic drilling unit 1 firstly moves to the first hole position 200 for drilling, the swivel assembly 103 rotates by 180° and is locked after the drilling at the first hole position 200 is completed, and the hydraulic drilling unit 1 moves to the third hole position 200 on a same straight line as the first hole position 200 for drilling; after the drilling at the third hole position 200 is completed, the hydraulic drilling unit 1 moves to the second hole position 200 for drilling; and after the drilling at second hole position 200 is completed, the swivel assembly 103 rotates by 180° in a reverse direction, and the hydraulic drilling unit 1 moves to the fourth hole position 200 for drilling.

According to the preceding moving route, the swivel assembly 103 only needs two rotations of 180°, that is, a forward rotation and a reverse rotation, the number of rotations is small, and locking positioning is performed after the rotations, thereby improving the construction safety and reli ability, and the operation is convenient and easy to control, thereby improving the drilling construction efficiency and reducing the labor intensity of workers.

In an embodiment, as shown in FIG. 1, in the case where four drilling platforms 100 are provided, the four drilling platforms 100 are arranged in a rectangular shape, and the fixing and mounting region 300 is provided at a central position of the four drilling platforms 100 at an equal distance from each of the four drilling platforms 100. Lengths of the air duct 303 and the compressed air conduit 202 between the hydraulic drilling unit 1 on the drilling platform 100 and the air compressor unit 2 and the dust remover 302 in the fixing and mounting region 300 are consistent so that no replacement needs to be performed, thereby saving construction costs, facilitating assembly and disassembly, and improving the construction efficiency.

In an embodiment, the operation bench 4 is arranged between the drilling platform 100 where the hydraulic drilling unit 1 is located and the fixing and mounting region 300. It is convenient for the operation bench 4 to take into account both a working state of the hydraulic drilling unit 1 and working states of the dust remover 302 and the air compressor units 2, thereby facilitating operation control, keeping an operator away from device noise, and facilitating the improvement of a working environment of the operator.

In an embodiment, when the hydraulic drilling unit 1 moves, the hydraulic drilling unit 1 is disconnected from the air compressor units 2 and the dust remover 302, thereby improving the construction safety.

The support legs 7 provided in the preceding embodiment are height-adjustable. When the track mechanisms 101 move, the support legs 7 are in a retracted state and capable of rotating synchronously with the rotating portion 1032; and when the support legs 7 are in a supporting state, the track mechanisms 101 are rotatable with the bridge 102 relative to the rotating portion 1032 so as to achieve turning of the track mechanisms 101.

In an embodiment, the turning of the track mechanisms 101 generally requires a relatively large space, and based on the limited space of the drilling platform 100, in this embodiment, the cooperation between the support legs 7 and the swivel assembly 103 can achieve the rotation of the track mechanisms 101 so as to achieve the turning of the track mechanisms 101, thereby reducing the torque damage of the track mechanisms 101 and improving the turning efficiency. Specifically, during implementation, it is necessary for the support legs 7 and the track mechanisms 101 to be alternately supported onto the ground and achieve the rotation and locking relative to the fixing portion 1031 and the rotating portion 1032 in the swivel assembly 103, and accordingly, at each rotational angular position, the corresponding locking mechanism 1033 is provided to improve the safe operability of the device.

In the preceding embodiments, modules are detachably connected to each other so that quick disassembly and assembly can be achieved. Each individual module is fixed through a frame on which a hoisting member is provided for hoisting. The detachable connection manner specifically includes that the bridge 102 is detachably connected to the track mechanism 101, the drill boom assembly module and the hydraulic drive module are detachably connected to the chassis 104, the chassis 104 is detachably connected to the rotating portion 1032, the dust collection cover 301 is detachably connected to the dust remover 302 through the air duct 303, and multiple air compressor units 2 are detachably connected to the hydraulic drilling unit 1 through the compressed air conduit 202. Specifically, for the detachable connection manner, reference is made to embodiment one.

Example Three: A Construction Method for the Drilling Platform 100

Based on the self-moving modular drilling device and the drilling construction method provided above, this embodiment provides a construction method for a drilling platform. A drilling process of an anchor rod foundation in the related art is: the drilling platform 100 is excavated firstly, and then the anchor rod drilling construction (including lofting, positioning and drilling) is performed on the drilling platform 100; the anchor rod construction operation is started before the excavation on the drilling platform 100; the drilling platform 100 in mountainous areas needs to be excavated manually, and when large rocks are encountered, the excavation progress is slow and the working efficiency is reduced. After the excavation on the drilling platform 100 is completed, the space of the drilling platform 100 is small, most of the drilling machinery cannot perform construction in the small space, the common down-the-hole drilling machine is difficult to set up, and the hole position adjustment takes a long time.

Based on the self-moving modular drilling device provided in the present application, S4 further includes the construction of the drilling platform, where the construction of the drilling platform includes the steps described below.

Firstly, drilling protection is performed for the anchor rod drilling.

Then, lofting and positioning are performed on the drilling platforms 100 according to a drilling position of an anchor rod.

The hydraulic drilling unit 1 performs drilling construction of the drilling platforms 100, and finally excavation is performed manually so as to form the drilling platforms 100.

In an embodiment, in contrast to a construction method for an anchor rod foundation in the related art, in the present application, after the anchor rod drilling construction is performed for the drilling platform 100, the drilling on the drilling platform 100 is performed, and then the excavation is performed manually so that the mechanization rate is high, the construction efficiency is high, the anchor rod drilling construction positioning is easy, and the drilling accuracy is high. The drilling protection is to protect the drilling hole with a steel pipe or a polyvinyl chloride (PVC) pipe. In the anchor rod drilling construction of the drilling platform 100, a drilling direction is shown by a direction of an arrow in FIG. 10, and the hydraulic drilling unit 1 performs drilling in sequence, thereby facilitating subsequent manual excavation.

What is claimed is:

1. A drilling device, comprising:

a hydraulic drilling unit capable of moving among a plurality of drilling platforms and among a plurality of hole positions on the plurality of drilling platforms, and performing a drilling operation;

a multi-way connector;

a compressed air conduit;

a plurality of air compressor units disposed in a fixing and mounting region that is between the plurality of drilling platforms, wherein compressed air outputted by the plurality of air compressor units flows jointly through the multi-way connector and then is transmitted to the hydraulic drilling unit through the compressed air conduit;

an air duct;

a dust removal unit comprising a dust collection cover and a dust remover, wherein the dust collection cover is configured to be located at any one of the plurality of hole positions, the dust remover is disposed in the fixing and mounting region, and the dust collection cover and the dust remover are connected through the air duct; and an operation bench connected to the hydraulic drilling unit, the plurality of air compressor units and the dust remover for communication and control;

wherein the hydraulic drilling unit comprises a drilling chassis module, a drill boom assembly module and a hydraulic drive module, wherein the drilling chassis module comprises two track mechanisms, one bridge and one swivel assembly, the two track mechanisms are symmetrically arranged at two ends of the bridge, the swivel assembly is rotatably connected to the bridge and disposed in a middle of the two track mechanisms, and the drill boom assembly module and the hydraulic drive module are both mounted on the swivel assembly.

2. The drilling device of claim 1, wherein each of the plurality of air compressor units comprises at least one air compressor module and at least one air compressor power module, wherein each air compressor power module is configured to drive a corresponding one of the at least one air compressor modules to generate and output the compressed air.

3. The drilling device of claim 2, further comprising an oil mist lubricator and a three-way joint, wherein a first port of the three-way joint communicates with the multi-way connector, a second port of the three-way joint communicates with an output end of one of the at least one air compressor modules, and a third port of the three-way joint is used as an air intake interface; and the oil mist lubricator communicates between the air intake interface, and an oil mist interface that is disposed on the multi-way connector.

4. The drilling device of claim 1, wherein first mounting portions are provided at the two ends of the bridge, the two track mechanisms comprise second mounting portions, the first mounting portions and the second mounting portions are detachably connected.

5. The drilling device of claim 4, wherein one of each of the first mounting portions or each of the second mounting portions is provided with a taper pin, and another one of each of the first mounting portions or each of the second mounting portions is provided with a taper shoe, wherein the taper pin and the taper shoe are provided with central connecting holes, the taper pin is inserted into the taper shoe, and a first connecting member is mounted in the two central connecting holes.

6. The drilling device of claim 1, wherein the drill boom assembly module comprises a chassis, a drill boom, an adjustment rod, a telescopic rod and a drive mechanism, wherein the chassis is fixedly connected to the swivel assembly and rotatable with the swivel assembly, a first end of the drill boom is a fixed end, a second end of the drill boom is an adjustment end, the fixed end is hinged with the chassis, a top end of the adjustment rod is hinged with the adjustment end, a bottom end of the adjustment rod is slidably connected to the chassis, a top end of the telescopic rod is hinged with the adjustment end, a bottom end of the telescopic rod is hinged with the chassis, and the drive mechanism is configured to drive the telescopic rod to move telescopically.

7. The drilling device of claim 6, wherein the hydraulic drive module is provided with at least three hydraulic output interfaces, each of the at least three hydraulic output interfaces is provided with a quick-plug joint, at least one of the at least three hydraulic output interfaces is connected to the two track mechanisms to drive the two track mechanisms to move, at least one of the at least three hydraulic output interfaces is connected to the drill boom assembly module to drive a drill bit of the drill boom to perform drilling, and at least one of the at least three hydraulic output interfaces is connected to the dust remover.

8. The drilling device of claim 6, wherein the swivel assembly comprises a fixed portion, a rotating portion and a locking mechanism, wherein the rotating portion is rotatably disposed on the fixed portion, the locking mechanism is capable of unlocking or locking the rotating portion relative to the fixed portion, the fixed portion is fixed on the bridge, and the rotating portion is fixedly connected to the chassis.

9. The drilling device of claim 6, further comprising a support mechanism, wherein the support mechanism comprises a support baseplate and a plurality of support legs, wherein the support baseplate is fixedly mounted on the chassis, the drill boom assembly module and the hydraulic drive module are carried above the support baseplate, and the plurality of support legs are arranged at intervals on the support baseplate and supported on the plurality of drilling platforms.

10. A drilling construction method for an electric power iron tower foundation, comprising:

determining a fixing and mounting region among a plurality of drilling platforms according to a layout of the plurality of drilling platforms of the electric power iron tower foundation, and determining a moving route of a hydraulic drilling unit according to distribution of a plurality of hole positions on the plurality of drilling platforms;

arranging a plurality of air compressor units and a dust remover in the fixing and mounting region, and providing the hydraulic drilling unit on any one of the plurality of drilling platforms;

placing an operation bench according to a sight line requirement, wherein the operation bench is communicatively connected to the hydraulic drilling unit, the plurality of air compressor units and the dust remover;

providing a dust collection cover at an aperture position of a first one of the plurality of hole positions on one drilling platform of the plurality of drilling platforms and connecting the dust collection cover to the dust remover through an air duct;

performing drilling on the first one of the plurality of hole positions on the one drilling platform through the hydraulic drilling unit, and completing drilling at all the plurality of hole positions on the one drilling platform the plurality of drilling platforms in sequence according to the moving route; and determining whether the one drilling platform is a last one of the plurality of drilling platforms; based on a result that the one drilling platform is not the last one of the plurality of drilling platforms, moving, by the hydraulic drilling unit, to a next drilling platform of the plurality of drilling platforms, providing a dust collection cover at an aperture position of a first one of the plurality of hole positions on the next drilling platform of the plurality of drilling platforms and connecting the dust collection cover to the dust remover through an air duct, and performing drilling on the first one of the plurality of hole positions on the next drilling platform through the hydraulic drilling unit, and completing drilling at all the plurality of hole positions on the next drilling platform of the plurality of drilling platforms in sequence according to the moving route, until drilling at all the plurality of hole positions on all the plurality of drilling platforms is completed.

11. The drilling construction method for an electric power iron tower foundation of claim 10, wherein the hydraulic drilling unit comprises two track mechanisms, a bridge, a drill boom assembly module and a hydraulic drive module, wherein the two track mechanisms are symmetrically arranged at two ends of the bridge, the drill boom assembly module and the hydraulic drive module are fixed on the bridge, and the hydraulic drive module is configured to drive the two track mechanisms to move.

12. The drilling construction method for the electric power iron tower foundation of claim 11, wherein the hydraulic drilling unit further comprises a swivel assembly, wherein the swivel assembly is rotatably connected to the bridge, and a swivel center of the swivel assembly coincides with a center of the bridge, and the swivel assembly comprises a fixed portion, a rotating portion and a locking mechanism, wherein the rotating portion is rotatably disposed on the fixed portion, the locking mechanism is capable of unlocking or locking the rotating portion relative to the fixed portion, the fixed portion is connected to the bridge, the rotating portion is provided with the drill boom assembly module and the hydraulic drive module, and the drill boom assembly module is rotatable relative to the bridge such that the drill boom assembly module is aligned with one of the plurality of hole positions.

13. The drilling construction method for the electric power iron tower foundation of claim 12, wherein four hole positions, which are a first hole position, a second hole position, a third hole position and a fourth hole position, are provided on the plurality of drilling platforms and arranged in a quadrilateral manner in sequence, and the moving route of the hydraulic drilling unit is as follows: the hydraulic drilling unit firstly moves to the first hole position for drilling, the swivel assembly rotates by 180° and is locked after the drilling at the first hole position is completed, and the hydraulic drilling unit moves to the third hole position on a same straight line as the first hole position for drilling; after the drilling at the third hole position is completed, the hydraulic drilling unit moves to the second hole position for drilling; and after the drilling at second hole position is completed, the swivel assembly rotates by 180° in a reverse direction, and the hydraulic drilling unit moves to the fourth hole position for drilling.

14. The drilling construction method for the electric power iron tower foundation of claim 12, wherein a plurality of support legs are disposed on the rotating portion of the swivel assembly and arranged at intervals, and the support legs are configured to be supported on the plurality of drilling platforms.

15. The drilling construction method for the electric power iron tower foundation of claim 14, wherein the support legs are height-adjustable, wherein when the two track mechanisms move, the support legs are in a retracted state and capable of rotating synchronously with the rotating portion; and when the support legs are in a supporting state, the two track mechanisms are rotatable with the bridge relative to the rotating portion so as to achieve turning of the two track mechanisms.

16. The drilling construction method for the electric power iron tower foundation of claim 10, wherein four drilling platforms are provided and arranged in a rectangular shape, and the fixing and mounting region is provided at a central position of the four drilling platforms at an equal distance from each of the four drilling platforms.

17. The drilling construction method for the electric power iron tower foundation of claim 10, wherein the operation bench is arranged between one of the plurality of drilling platforms where the hydraulic drilling unit is located, and the fixing and mounting region.

18. The drilling construction method for the electric power iron tower foundation of claim 10, wherein when the hydraulic drilling unit moves, the hydraulic drilling unit is disconnected from the plurality of air compressor units and the dust remover.

19. The drilling construction method for the electric power iron tower foundation of claim 10, wherein performing the drilling on the first one of the plurality of hole positions through the hydraulic drilling unit and completing drilling on all the plurality of hole positions on the plurality of drilling platforms in sequence according to the moving route comprises:

performing drilling protection for the drilling;

performing lofting and positioning on the plurality of drilling platforms according to a drilling position of an anchor rod;

performing, by the hydraulic drilling unit, drilling construction of the plurality of drilling platforms; and performing excavation manually to form the plurality of drilling platforms.

20. A drilling device, comprising:

a hydraulic drilling unit capable of moving among a plurality of drilling platforms and among a plurality of hole positions on the plurality of drilling platforms, and performing a drilling operation;

a multi-way connector;

a compressed air conduit;

a plurality of air compressor units disposed in a fixing and mounting region that is between the plurality of drilling platforms, wherein compressed air outputted by the plurality of air compressor units flows jointly through the multi-way connector and then is transmitted to the hydraulic drilling unit through the compressed air conduit;

an air duct;

a dust removal unit comprising a dust collection cover and a dust remover, wherein the dust collection cover is configured to be located at any one of the plurality of hole positions, the dust remover is disposed in the fixing and mounting region, and the dust collection cover and the dust remover are connected through the air duct; and an operation bench connected to the hydraulic drilling unit, the plurality of air compressor units and the dust remover for communication and control;

wherein each of the plurality of air compressor units comprises at least one air compressor module and at least one air compressor power module, wherein each of the at least one air compressor power module is configured to drive a corresponding one of the at least one air compressor module to generate and output the compressed air;

the drilling device further comprises an oil mist lubricator and a three-way joint, wherein a first port of the three-way joint communicates with the multi-way connector, a second port of the three-way joint communicates with an output end of one of the at least one air compressor module, and a third port of the three-way joint is used as an air intake interface; and the oil mist lubricator communicates between the air intake interface, and an oil mist interface that is disposed on the multi-way connector.

* * * * *